US010317920B2

(12) United States Patent
Li

(10) Patent No.: US 10,317,920 B2
(45) Date of Patent: Jun. 11, 2019

(54) CIRCUIT STARTING METHOD, CONTROL CIRCUIT AND VOLTAGE REFERENCE

(71) Applicant: ZTE CORPORATION, Shenzhen, Guangdong Province (CN)

(72) Inventor: Binbin Li, Shenzhen (CN)

(73) Assignee: ZTE CORPORATION, Shenzhen, Guangdong Province (CN)

( * ) Notice: Subject to any disclaimer, the term of this patent is extended or adjusted under 35 U.S.C. 154(b) by 0 days.

(21) Appl. No.: 15/503,196

(22) PCT Filed: Jan. 20, 2015

(86) PCT No.: PCT/CN2015/071145

§ 371 (c)(1),
(2) Date: Feb. 10, 2017

(87) PCT Pub. No.: WO2015/154566

PCT Pub. Date: Oct. 15, 2015

(65) Prior Publication Data

US 2017/0227976 A1 Aug. 10, 2017

(30) Foreign Application Priority Data

Aug. 15, 2014 (CN) ..... 2014 1 0404099

(51) Int. Cl.
*G05F 1/10* (2006.01)
*G05F 1/46* (2006.01)
(Continued)

(52) U.S. Cl.
CPC ..... *G05F 1/468* (2013.01); *G05F 1/56* (2013.01); *G05F 3/242* (2013.01); *G05F 3/30* (2013.01)

(58) Field of Classification Search
None
See application file for complete search history.

(56) References Cited

U.S. PATENT DOCUMENTS 6,784,652 B1 8/2004 Aude
7,301,312 B2 * 11/2007 Nishino ..... H02M 1/32 323/222
(Continued)

FOREIGN PATENT DOCUMENTS

CN 101673938 A 3/2010
CN 102147630 A 8/2011
(Continued)

OTHER PUBLICATIONS

International Sear Report, International application No. PCT/CN2015/071145, dated Apr. 10, 2015.
(Continued)

*Primary Examiner* — Lincoln D Donovan
*Assistant Examiner* — Khareem E Almo
(74) *Attorney, Agent, or Firm* — Ferguson Case Orr Paterson LLP

(57) ABSTRACT

A circuit starting method, a control circuit and a voltage reference circuit are provided. The control circuit includes an operational amplifier circuit and a comparison control circuit, wherein the operational amplifier circuit is arranged to establish an input reference voltage (VREF_INT) and an output reference voltage (VREF_OUT) by means of an operational amplifier (EA) and an external capacitor (C); and the comparison control circuit is arranged to, when the input reference voltage (VREF_INT) and the output reference voltage (VREF_OUT) are consistent, execute a toggle operation and output an enable signal (VREF_OK) to the operational amplifier (EA) so as to shut down the operational amplifier (EA).

14 Claims, 2 Drawing Sheets

(51) Int. Cl.

| | |
|---|---|
| ***G05F 1/56*** | (2006.01) |
| ***G05F 3/24*** | (2006.01) |
| ***G05F 3/30*** | (2006.01) |

(56) References Cited

U.S. PATENT DOCUMENTS

| | | | | |
|---|---|---|---|---|
| 9,748,852 | B2 * | 8/2017 | Freeman | H02M 3/33546 |
| 2010/0156520 | A1 | 1/2010 | Kume | |
| 2016/0154415 | A1 * | 6/2016 | B z itu | G05F 1/575<br>323/280 |

FOREIGN PATENT DOCUMENTS

| | | | |
|---|---|---|---|
| CN | 102609023 | | 7/2012 |
| CN | 103036538 | A | 4/2013 |
| CN | 103647519 | A | 3/2014 |
| CN | 203520222 | | 4/2014 |
| CN | 103885517 | | 6/2014 |
| CN | 103905006 | A | 7/2014 |
| CN | 103973237 | A | 8/2014 |
| WO | 2013147806 | | 10/2013 |
| WO | 2014038785 | | 3/2014 |

OTHER PUBLICATIONS

European Search Report for Application No. 15776793.0; dated Aug. 22, 2017.

* cited by examiner

CIRCUIT STARTING METHOD, CONTROL CIRCUIT AND VOLTAGE REFERENCE

TECHNICAL FIELD

The present disclosure relates to a circuit control technology, and in particular to a circuit starting method, a control circuit and a voltage reference circuit.

BACKGROUND

At present, voltage reference generation circuits are widely applied in analog circuit systems. In consideration of requirements for high precision and lower power consumption of the voltage reference generation circuits, a microfarad-level large capacitor is usually externally connected to an output end of the circuit in order to meet such requirements. However, starting time of the entire circuit is delayed by the large capacitor externally connected to the output end of the circuit, which is not beneficial to large-scale product testing.

SUMMARY

Embodiments of the present disclosure provide a circuit starting method, a control circuit and a voltage reference circuit, which are capable of quickly starting a circuit under the premise of meeting index requirements for high precision and low power consumption.

The technical solution in the embodiments of the present disclosure is implemented as follows.

An embodiment of the present disclosure provides a control circuit, which may include: an operational amplifier circuit and a comparison control circuit, wherein the operational amplifier circuit is arranged to establish an input reference voltage and an output reference voltage by means of an operational amplifier and an external capacitor; and the comparison control circuit is arranged to, when the input reference voltage and the output reference voltage are consistent, execute a toggle operation and output an enable signal to the operational amplifier so as to shut down the operational amplifier.

In the above-mentioned solution, the comparison control circuit may be a comparator.

Correspondingly, the input reference voltage and output reference voltage of the operational amplifier circuit may serve as inputs of the comparator, and an output of the comparator may be the enable signal.

In the above-mentioned solution, the comparator may be a comparator with a falling hysteresis.

In the above-mentioned solution, the operational amplifier circuit may include: a power supply, the operational amplifier, a transistor, the external capacitor, a bias current source, and a resistor, wherein the transistor is a P-channel Metal Oxide Semiconductor (PMOS) tube or an N-channel Metal Oxide Semiconductor (NMOS) tube.

In the above-mentioned solution, when the transistor in the operational amplifier circuit is the PMOS tube, the power supply is connected with a power input end of the operational amplifier and a drain of the PMOS tube; an output end of the operational amplifier is connected with a gate of the PMOS tube; a source of the PMOS tube is connected with one end of the external capacitor and a positive end of the bias current source respectively; both the other end of the external capacitor and a negative end of the bias current source are grounded; the input reference voltage serves as a non-inverting input of the operational amplifier; a source voltage of the PMOS tube is the output reference voltage, and the output reference voltage serves as an inverting input of the operational amplifier; and a non-inverting input end of the operational amplifier is connected with an inverting input end of the operational amplifier via the resistor.

Another embodiment of the present disclosure provides a circuit starting method, which may include the following steps.

An input reference voltage and an output reference voltage are established by means of an operational amplifier and an external capacitor in an operational amplifier circuit; and when the input reference voltage and the output reference voltage are consistent, a comparison control circuit executes a toggle operation and outputs an enable signal to the operational amplifier so as to shut down the operational amplifier.

Still another embodiment of the present disclosure provides a voltage reference circuit, which may include: a voltage reference generation circuit and a control circuit for controlling the voltage reference generation circuit, the control circuit including an operational amplifier circuit and a comparison control circuit, wherein the operational amplifier circuit is arranged to establish an input reference voltage and an output reference voltage by means of an operational amplifier and an external capacitor; and the comparison control circuit is arranged to, when the input reference voltage and the output reference voltage are consistent, execute a toggle operation and output an enable signal to the operational amplifier so as to shut down the operational amplifier.

According to the circuit starting method, the control circuit and the voltage reference circuit provided by the embodiments of the present disclosure, an input reference voltage and an output reference voltage are established by means of an operational amplifier and an external capacitor in an operational amplifier circuit; and when the input reference voltage and the output reference voltage are consistent, a comparison control circuit executes a toggle operation and outputs an enable signal to the operational amplifier so as to shut down the operational amplifier. Thus, a circuit can be quickly started under the premise of meeting index requirements for high precision and low power consumption.

Moreover, in the embodiments of the present disclosure, an implementation solution for the control circuit is simple and convenient, and the control circuit is easy to implement.

DETAILED DESCRIPTION OF THE EMBODIMENTS

In the embodiments of the present disclosure, an input reference voltage and an output reference voltage are established by means of an operational amplifier and an external capacitor in an operational amplifier circuit; and when the input reference voltage and the output reference voltage are consistent, a comparison control circuit executes a toggle operation and outputs an enable signal to the operational amplifier so as to shut down the operational amplifier.

The present disclosure will be further described in detail hereinbelow in combination with the accompanying drawings and specific embodiments.

Figure 1:
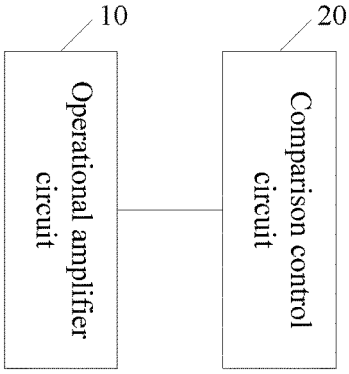
FIG. 1 is a composition structure diagram of a control circuit according to an embodiment of the present disclosure.

FIG. 1 is a composition structure diagram of a control circuit according to an embodiment of the present disclosure. As shown in FIG. 1, the control circuit includes: an operational amplifier circuit 10 and a comparison control circuit 20.

The operational amplifier circuit 10 is arranged to establish an input reference voltage and an output reference voltage by means of an operational amplifier and an external capacitor.

The comparison control circuit 20 is arranged to, when the input reference voltage and the output reference voltage are consistent, execute a toggle operation and output an enable signal to the operational amplifier so as to shut down the operational amplifier.

Figure 2:
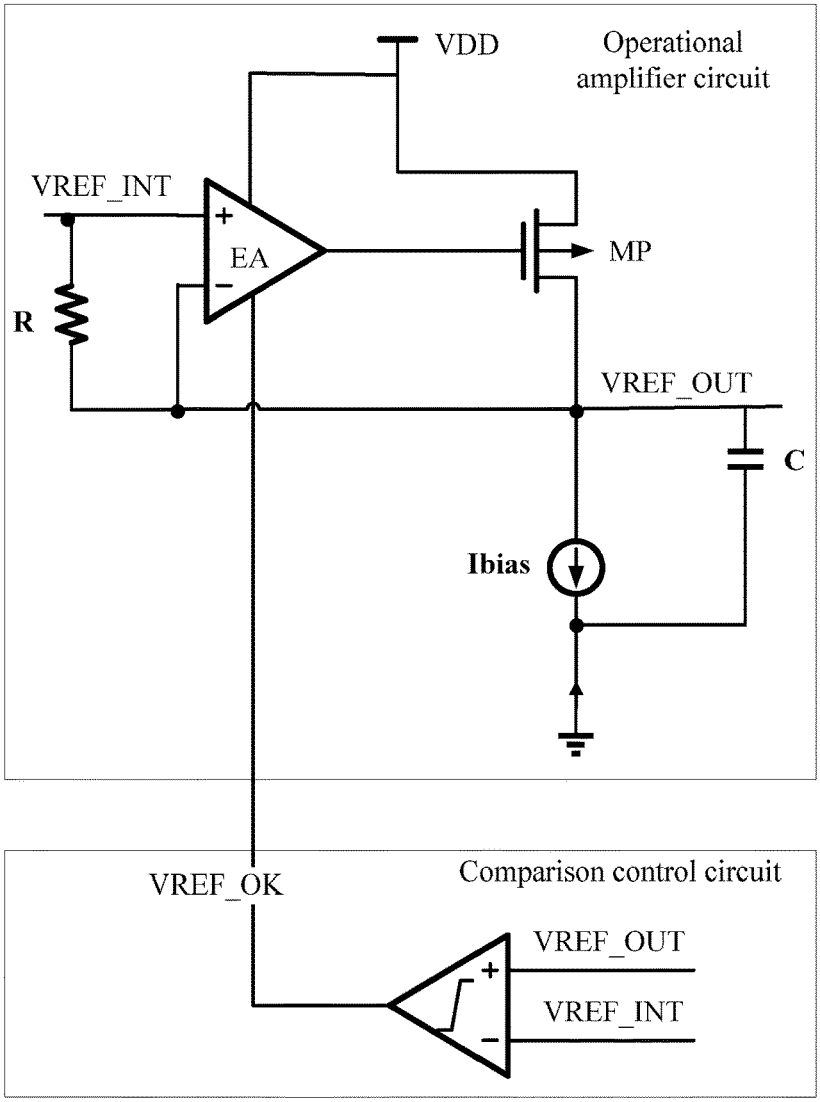
FIG. 2 is a composition structure diagram of a control circuit in practical application according to an embodiment of the present disclosure.

As shown in FIG. 2, in practical application, the operational amplifier circuit 10 may include: a power supply VDD, an operational amplifier EA, a transistor MP, an external capacitor C, a bias current source Ibias, and a resistor R. The transistor MP may be a PMOS tube or an NMOS tube.

As shown in FIG. 2, in practical application, the comparison control circuit 20 may be a comparator.

Correspondingly, an input reference voltage VREF_INT of the operational amplifier circuit 10 and an output reference voltage VREF_OUT of the operational amplifier circuit 10 serve as inputs of the comparator, and an output of the comparator is the enable signal VREF_OK.

In the operational amplifier circuit 10, when the transistor MP is the PMOS tube, a connecting relationship among all components contained in the operational amplifier circuit is as shown in FIG. 2.

The power supply VDD is connected with a power input end of the operational amplifier EA and a drain of the PMOS tube MP. An output end of the operational amplifier EA is connected with a gate of the PMOS tube MP. A source of the PMOS tube MP is connected with one end of the external capacitor C and a positive end of the bias current source Ibias respectively. Both the other end of the external capacitor C and a negative end of the bias current source Ibias are grounded. The input reference voltage VREF_INT serves as a non-inverting input of the operational amplifier EA. A source voltage of the PMOS tube MP is the output reference voltage VREF_OUT, and the output reference voltage VREF_OUT serves as an inverting input of the operational amplifier EA. A non-inverting input end of the operational amplifier EA is connected with an inverting input end of the operational amplifier EA via the resistor R.

In practical application, as shown in FIG. 2, when a voltage reference generation circuit is powered on by the power supply VDD, a reference core starts to work to generate a reference voltage VREF_INT, which serves as a non-inverting input of the operational amplifier EA. It is important to note that since the reference core only has a small capacitive load, the reference voltage VREF_INT can be quickly established after the entire voltage reference generation circuit is powered on by the power supply VDD, and can serve as an input reference voltage VREF_INT of the quickly started voltage reference generation circuit. Further, the operational amplifier EA is connected in a unit gain negative feedback form, so that voltages at the two input ends of the operational amplifier EA are clamped to be equal. Meanwhile, an output reference voltage VREF_OUT is connected to an output end of the operational amplifier EA, and serves as an output of the entire voltage reference generation circuit, so as to provide a reference voltage for other external circuits.

In practical application, since an analog circuit system has a relatively high precision requirement on the voltage reference generation circuit and has requirements for a small noise as well as a good power rejection ratio, a microfarad (uF)-level large capacitor C is usually connected to the output reference voltage VREF_OUT end.

However, a large capacitor and a small reference current cause a long time for the establishment of the output reference voltage VREF_OUT, as a result, after the input reference voltage VREF_INT is completely established, the output reference voltage VREF_OUT is still in a low level. At this time, the non-inverting input end of the operational amplifier EA is at a high level, the inverting input end is at a low level, and the operational amplifier EA works in a comparator mode. A gate output of the transistor MP is at a low level, and the transistor MP used as a switch tube is opened to further charge the external capacitor C. The magnitude of the current depends on a width-to-length ratio of the transistor MP. The establishment time for the output reference voltage VREF_OUT would be much shorter while the current is larger. However, since the operational amplifier EA has a certain response time, the external capacitor C would be over-charged due to over large current.

When the output reference voltage VREF_OUT approaches the input reference voltage VREF_INT after being established, the operational amplifier EA starts to enter an operational amplification mode. The output reference voltage VREF_OUT prevented from continuously rising by using a negative feedback, so that the external capacitor C would not be continuously charged. The transistor MP works in a saturation region, so that the output reference voltage VREF_OUT and the input reference voltage VREF_INT are clamped, that is, the output reference voltage VREF_OUT reaches a set value.

However, since the operational amplifier EA has a certain response time, if a current flowing through the transistor MP is over large, then the output reference voltage VREF_OUT would have a small over-charging voltage. However, when the establishment time of the output reference voltage VREF_OUT is required to be relatively short, the current flowing through the transistor MP is required to be large, and the over-charging voltage is unavoidable. Due to the existence of the operational amplifier EA, the rising amplitude of the over-charging voltage is small, and the voltage can be recovered within a short time. Meanwhile, a sufficient toggle space may be provided for the comparator by using the over-charging voltage. It is important to note that due to the existence of the over-charging voltage, the bias current source Ibias is required to be large enough, so as to ensure that the over-charging voltage of the output reference voltage VREF_OUT can be reduced to a set value within a short time.

Further, when establishment of the output reference voltage VREF_OUT is completed, the comparator toggles, and an enable signal VREF_OK is provided for the operational amplifier EA. The enable signal VREF_OK controls the operational amplifier EA to be shut down, thereby avoiding unnecessary power waste.

Meanwhile, the non-inverting input end and inverting input end of the operational amplifier EA are connected via the resistor R. The resistor R has two functions as follows. (1) Theoretically, voltages at the two input ends of the operational amplifier EA are ensured to be consistent while preventing an over large current, so that the external capacitor C and the input reference voltage VREF_INT are prevented from direct connection, to keep the input reference voltage VREF_INT not affected. (2) It is ensured that the output reference voltage VREF_OUT serves as an output of the entire voltage reference generation circuit, and when reference voltages are provided for other external circuits, if the output end has a slight electric leakage, the input reference voltage VREF_INT may provide a small current for the output reference voltage VREF_OUT via the resistor R, thereby ensuring the stability of the output reference voltage VREF_OUT.

Figure 3:
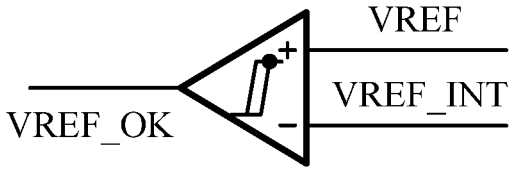
FIG. 3 is a structure diagram of a hysteresis comparator according to an embodiment of the present disclosure.

Further, if the output end has a relatively large electric leakage, the current provided for the output reference voltage VREF_OUT by the input reference voltage VREF_INT via the resistor cannot meet demands, and the output reference voltage VREF_OUT would be continuously reduced. Therefore, in an embodiment of the present disclosure, a comparator as shown in FIG. 3 may be further provided. The comparator may be a hysteresis comparator. Since the comparator has a semi-hysteresis function, a hysteresis effect can be generated only when the output reference voltage VREF_OUT is reduced. That is, the hysteresis comparator would not toggle until the output reference voltage VREF_OUT is smaller than the input reference voltage VREF_INT to a certain extent. A toggle threshold for a rising process of the output reference voltage VREF_OUT is still equal to the input reference voltage VREF_INT. When the output reference voltage VREF_OUT is reduced to a certain extent, the hysteresis comparator toggles again, so that the operational amplifier EA is enabled again, the external capacitor C can be re-charged via the MP tube until the output reference voltage VREF_OUT reaches a value of the input reference voltage VREF_INT again.

Thus, by means of the voltage reference generation circuit in the embodiments of the present disclosure, the voltage reference generation circuit can be quickly started under the premise of meeting index requirements for high precision and low power consumption.

On the basis of the above-mentioned voltage reference generation circuit, another embodiment of the present disclosure provides a circuit starting method. The method includes that: an input reference voltage and an output reference voltage are established by means of an operational amplifier and an external capacitor in an operational amplifier circuit; and when the input reference voltage and the output reference voltage are consistent, a comparison control circuit executes a toggle operation and outputs an enable signal VREF_OK to the operational amplifier so as to shut down the operational amplifier.

On the basis of the above-mentioned control circuit, still another embodiment of the present disclosure provides a voltage reference circuit, including: a voltage reference generation circuit and a control circuit for controlling the voltage reference generation circuit. As shown in FIG. 1, the control circuit includes: an operational amplifier circuit 10 and a comparison control circuit 20.

The operational amplifier circuit 10 is arranged to establish an input reference voltage and an output reference voltage by means of an operational amplifier and an external capacitor.

The comparison control circuit 20 is arranged to, when the input reference voltage and the output reference voltage are consistent, execute a toggle operation and output an enable signal VREF_OK to the operational amplifier so as to shut down the operational amplifier.

As shown in FIG. 2, in practical application, the operational amplifier circuit 10 includes: a power supply VDD, an operational amplifier EA, a transistor MP, an external capacitor C, a bias current source Ibias, and a resistor R. The transistor MP may be a PMOS tube or an NMOS tube.

As shown in FIG. 2, in practical application, the comparison control circuit 20 may be a comparator.

Correspondingly, an input reference voltage VREF_INT and output reference voltage VREF_OUT of the operational amplifier circuit 10 serve as inputs of the comparator, and an output of the comparator is an enable signal VREF_OK.

In the operational amplifier circuit 10, when the transistor MP is the PMOS tube, a connecting relationship among all components of the operational amplifier circuit is shown in FIG. 2.

The power supply VDD is connected with a power input end of the operational amplifier EA and a drain of the PMOS tube MP. An output end of the operational amplifier EA is connected with a gate of the PMOS tube MP. A source of the PMOS tube MP is connected with one end of the external capacitor C and a positive end of the bias current source Ibias respectively. Both the other end of the external capacitor C and a negative end of the bias current source Ibias are grounded. The input reference voltage VREF_INT serves as a non-inverting input of the operational amplifier EA. A source voltage of the PMOS tube MP is the output reference voltage VREF_OUT, and the output reference voltage VREF_OUT serves as an inverting input of the operational amplifier EA. A non-inverting input end of the operational amplifier EA is connected with an inverting input end of the operational amplifier EA via the resistor R.

In practical application, as shown in FIG. 2, when a voltage reference generation circuit is powered on by the power supply VDD, a reference core starts to work to generate a reference voltage VREF_INT, which serves as a non-inverting input of the operational amplifier EA. It is important to note that since the reference core only has a small capacitive load, the reference voltage VREF_INT can be quickly established after the entire voltage reference generation circuit is powered on by the power supply VDD, and can serve as an input reference voltage VREF_INT of the quickly started voltage reference generation circuit. Further, the operational amplifier EA is connected in a unit gain negative feedback form, so that voltages at the two input ends of the operational amplifier EA are clamped to be equal. Meanwhile, an output reference voltage VREF_OUT is connected to an output end of the operational amplifier EA, and serves as an output of the entire voltage reference generation circuit, so as to provide a reference voltage for other external circuits.

In practical application, since an analog circuit system has a relatively high precision requirement on the voltage reference generation circuit and has requirements for a small noise as well as a good power rejection ratio, a microfarad (uF)-level large capacitor C is usually connected to the output reference voltage VREF_OUT end.

However, a large capacitor and a small reference current cause a long time for the establishment of the output reference voltage VREF_OUT, as a result, after the input reference voltage VREF_INT is completely established, the output reference voltage VREF_OUT is still in a low level. At this time, the non-inverting input end of the operational amplifier EA is at a high level, the inverting input end is at a low level, and the operational amplifier EA works in a comparator mode. A gate output of the transistor MP is at a low level, and the transistor MP used as a switch tube is opened to further charge the external capacitor C. The magnitude of the current depends on a width-to-length ratio of the transistor MP. The establishment time for the output reference voltage VREF_OUT would be much shorter while the current is larger. However, since the operational amplifier EA has a certain response time, the external capacitor C would be over-charged due to over large current.

When the output reference voltage VREF_OUT approaches the input reference voltage VREF_INT after being established, the operational amplifier EA starts to enter an operational amplification mode. The output reference voltage VREF_OUT is prevented from continuously rising by using a negative feedback, so that the external capacitor C would not be continuously charged. The transistor MP works in a saturation region, so that the output reference voltage VREF_OUT and the input reference voltage VREF_INT are clamped, that is, the output reference voltage VREF_OUT reaches a set value.

However, since the operational amplifier EA has a certain response time, if a current flowing through the transistor MP is over large, then the output reference voltage VREF_OUT would have a small over-charging voltage. However, when the establishment time of the output reference voltage VREF_OUT is required to be relatively short, the current flowing through the transistor MP is required to be large, and the over-charging voltage is unavoidable. Due to the existence of the operational amplifier EA, the rising amplitude of the over-charging voltage is small, and the voltage can be recovered within a short time. Meanwhile, a sufficient toggle space may be provided for the comparator by using the over-charging voltage. It is important to note that due to the existence of the over-charging voltage, the bias current source Ibias is required to be large enough, so as to ensure that the over-charging voltage of the output reference voltage VREF_OUT can be reduced to a set value within a short time.

Further, when establishment of the output reference voltage VREF_OUT is completed, the comparator toggles, and an enable signal VREF_OK is provided for the operational amplifier EA. The enable signal VREF_OK controls the operational amplifier EA to be shut down, thereby avoiding unnecessary power waste.

Meanwhile, the non-inverting input end and inverting input end of the operational amplifier EA are connected via the resistor R. The resistor R has two functions as follows. (1) Theoretically, voltages at the two input ends of the operational amplifier EA are ensured to be consistent while preventing an over large current, so that the external capacitor C and the input reference voltage VREF_INT are prevented from direct connection, to keep the input reference voltage VREF_INT not affected. (2) It is ensured that the output reference voltage VREF_OUT serves as an output of the entire voltage reference generation circuit, and when reference voltages are provided for other external circuits, if the output end has a slight electric leakage, the input reference voltage VREF_INT may provide a small current for the output reference voltage VREF_OUT via the resistor R, thereby ensuring the stability of the output reference voltage VREF_OUT.

Further, if the output end has a relatively large electric leakage, the current provided for the output reference voltage VREF_OUT by the input reference voltage VREF_INT via the resistor cannot meet demands, and the output reference voltage VREF_OUT would be continuously reduced. Therefore, in an embodiment of the present disclosure, a comparator as shown in FIG. 3 may be further provided. The comparator may be a hysteresis comparator. Since the comparator has a semi-hysteresis function, a hysteresis effect can be generated only when the output reference voltage VREF_OUT is reduced. That is, the hysteresis comparator would not toggle until the output reference voltage VREF_OUT is smaller than the input reference voltage VREF_INT to a certain extent. A toggle threshold for a rising process of the output reference voltage VREF_OUT is still equal to the input reference voltage VREF_INT. When the output reference voltage VREF_OUT is reduced to a certain extent, the hysteresis comparator toggles again, so that the operational amplifier EA is enabled again, the external capacitor C can be re-charged via the MP tube until the output reference voltage VREF_OUT reaches a value of the input reference voltage VREF_INT again.

The above is only exemplary embodiments of the present disclosure, and not intended to limit the scope of protection defined by the appended claims of the present disclosure.

INDUSTRIAL APPLICABILITY

As above, the circuit starting method, the control circuit and the voltage reference circuit provided by the embodiments of the present disclosure have the following beneficial effects. An input reference voltage and an output reference voltage are established by means of an operational amplifier and an external capacitor in an operational amplifier circuit. When the input reference voltage and the output reference voltage are consistent, a comparison control circuit executes a toggle operation and outputs an enable signal to the operational amplifier so as to shut down the operational amplifier. Thus, a circuit can be quickly started under the premise of meeting index requirements for high precision and low power consumption.

What is claimed is:

1. A control circuit, comprising: an operational amplifier circuit and a comparison control circuit, wherein:

the operational amplifier circuit is arranged to establish an input reference voltage and an output reference voltage by means of an operational amplifier and an external capacitor; and the comparison control circuit is arranged to, when the input reference voltage and the output reference voltage are consistent, execute a toggle operation and output an enable signal to the operational amplifier so as to shut down the operational amplifier;

wherein the operational amplifier circuit comprises: a power supply, the operational amplifier, a transistor, the external capacitor, a bias current source, and a resistor, the transistor is a P-channel Metal Oxide Semiconductor (PMOS) tube; the power supply is connected with a power input end of the operational amplifier and a drain of the PMOS tube; an output end of the operational amplifier is connected with a gate of the PMOS tube; a source of the PMOS tube is connected with one end of the external capacitor and a positive end of the bias current source respectively; both the other end of the external capacitor and a negative end of the bias current source are grounded; the input reference voltage serves as a non-inverting input of the operational amplifier; a source voltage of the PMOS tube is the output reference voltage, and the output reference voltage serves as an inverting input of the operational amplifier; and a non-inverting input end of the operational amplifier is connected with an inverting input end of the operational amplifier via the resistor.

2. The control circuit as claimed in claim 1, wherein the comparison control circuit is a comparator; and the input reference voltage and output reference voltage of the operational amplifier circuit serve as inputs of the comparator, and an output of the comparator is the enable signal.

3. The control circuit as claimed in claim 2, wherein the comparator is a comparator with a falling hysteresis.

4. A circuit starting method applied to the control circuit as claimed in claim 1, comprising:

establishing an input reference voltage and an output reference voltage by means of an operational amplifier and an external capacitor in an operational amplifier circuit; and when the input reference voltage and the output reference voltage are consistent, executing, by a comparison control circuit, a toggle operation, and outputting, by the comparison control circuit, an enable signal to the operational amplifier so as to shut down the operational amplifier.

5. A voltage reference circuit, comprising: a voltage reference generation circuit and a control circuit for controlling the voltage reference generation circuit, the control circuit comprising an operational amplifier circuit and a comparison control circuit, wherein the operational amplifier circuit is arranged to establish an input reference voltage and an output reference voltage by means of an operational amplifier and an external capacitor; and the comparison control circuit is arranged to, when the input reference voltage and the output reference voltage are consistent, execute a toggle operation and output an enable signal to the operational amplifier so as to shut down the operational amplifier.

6. The voltage reference circuit as claimed in claim 5, wherein the comparison control circuit is a comparator; and the input reference voltage and output reference voltage of the operational amplifier circuit serve as inputs of the comparator, and an output of the comparator is the enable signal.

7. The voltage reference circuit as claimed in claim 5, wherein the operational amplifier circuit comprises: a power supply, the operational amplifier, a transistor, the external capacitor, a bias current source, and a resistor, wherein the transistor is a P-channel Metal Oxide Semiconductor (PMOS) tube or an N-channel Metal Oxide Semiconductor (NMOS) tube.

8. The voltage reference circuit as claimed in claim 7, wherein when the transistor in the operational amplifier circuit is the PMOS tube, the power supply is connected with a power input end of the operational amplifier and a drain of the PMOS tube; an output end of the operational amplifier is connected with a gate of the PMOS tube; a source of the PMOS tube is connected with one end of the external capacitor and a positive end of the bias current source respectively; both the other end of the external capacitor and a negative end of the bias current source are grounded; the input reference voltage serves as a non-inverting input of the operational amplifier; a source voltage of the PMOS tube is the output reference voltage, and the output reference voltage serves as an inverting input of the operational amplifier; and a non-inverting input end of the operational amplifier is connected with an inverting input end of the operational amplifier via the resistor.

9. The voltage reference circuit as claimed in claim 6, wherein the comparator is a comparator with a falling hysteresis.

10. The voltage reference circuit as claimed in claim 6, wherein the operational amplifier circuit comprises: a power supply, the operational amplifier, a transistor, the external capacitor, a bias current source, and a resistor, wherein the transistor is a P-channel Metal Oxide Semiconductor (PMOS) tube or an N-channel Metal Oxide Semiconductor (NMOS) tube.

11. The voltage reference circuit as claimed in claim 9, wherein the operational amplifier circuit comprises: a power supply, the operational amplifier, a transistor, the external capacitor, a bias current source, and a resistor, wherein the transistor is a P-channel Metal Oxide Semiconductor (PMOS) tube or an N-channel Metal Oxide Semiconductor (NMOS) tube.

12. The voltage reference circuit as claimed in claim 10, wherein when the transistor in the operational amplifier circuit is the PMOS tube, the power supply is connected with a power input end of the operational amplifier and a drain of the PMOS tube; an output end of the operational amplifier is connected with a gate of the PMOS tube; a source of the PMOS tube is connected with one end of the external capacitor and a positive end of the bias current source respectively; both the other end of the external capacitor and a negative end of the bias current source are grounded; the input reference voltage serves as a non-inverting input of the operational amplifier; a source voltage of the PMOS tube is the output reference voltage, and the output reference voltage serves as an inverting input of the operational amplifier; and a non-inverting input end of the operational amplifier is connected with an inverting input end of the operational amplifier via the resistor.

13. The voltage reference circuit as claimed in claim 11, wherein when the transistor in the operational amplifier circuit is the PMOS tube, the power supply is connected with a power input end of the operational amplifier and a drain of the PMOS tube; an output end of the operational amplifier is connected with a gate of the PMOS tube; a source of the PMOS tube is connected with one end of the external capacitor and a positive end of the bias current source respectively; both the other end of the external capacitor and a negative end of the bias current source are grounded; the input reference voltage serves as a non-inverting input of the operational amplifier; a source voltage of the PMOS tube is the output reference voltage, and the output reference voltage serves as an inverting input of the operational amplifier; and a non-inverting input end of the operational amplifier is connected with an inverting input end of the operational amplifier via the resistor.

14. The circuit starting method as claimed in claim 4, wherein when a voltage reference generation circuit is powered on by a power supply, a reference core starts to work to generate the input reference voltage VREF_INT, which serves as a non-inverting input of the operational amplifier; the output reference voltage VREF_OUT is connected to an output end of the operational amplifier, and serves as an output of the entire voltage reference generation circuit, so as to provide a reference voltage for other external circuits, wherein the operational amplifier is connected in a unit gain negative feedback form, so that voltages at two input ends of the operational amplifier are clamped to be equal.

* * * * *